US010488128B2

(12) United States Patent
Leitner-Wise

(10) Patent No.: US 10,488,128 B2
(45) Date of Patent: Nov. 26, 2019

(54) BOLT CARRIER WITH A MODIFIED CAM PATH

(71) Applicant: Paul Leitner-Wise, Washington, DC (US)

(72) Inventor: Paul Leitner-Wise, Washington, DC (US)

( * ) Notice: Subject to any disclaimer, the term of this patent is extended or adjusted under 35 U.S.C. 154(b) by 0 days.

(21) Appl. No.: 16/200,625

(22) Filed: Nov. 26, 2018

(65) Prior Publication Data

US 2019/0195580 A1 Jun. 27, 2019

Related U.S. Application Data

(60) Provisional application No. 62/593,965, filed on Dec. 3, 2017.

(51) Int. Cl.
*F41A 3/16* (2006.01)
*F41A 3/26* (2006.01)

(52) U.S. Cl.
CPC . *F41A 3/16* (2013.01); *F41A 3/26* (2013.01)

(58) Field of Classification Search
CPC ..... F41A 3/16
USPC ..... 42/16
See application file for complete search history.

(56) References Cited

U.S. PATENT DOCUMENTS

| | | | | |
|---|---|---|---|---|
| 4,141,276 | A * | 2/1979 | Taylor | F41A 3/26 89/11 |
| 8,713,833 | B2 | 5/2014 | Lewis et al. | |
| 9,488,423 | B2 | 2/2016 | Sullivan et al. | |
| 9,885,529 | B2 | 2/2018 | Lewis | |
| 10,151,544 | B1 | 12/2018 | Sugg | |
| 2007/0199434 | A1* | 8/2007 | Crotty | F41A 19/34 89/45 |
| 2017/0074607 | A1* | 3/2017 | Lewis | F41A 3/26 |
| 2017/0321978 | A1* | 11/2017 | Brannan | F41A 5/28 |
| 2018/0142972 | A1* | 5/2018 | Overstreet | F41A 19/30 |

OTHER PUBLICATIONS

M16 BCG Drawing Set (AMSWE Form 403B, Jul. 29, 1969), p. 1-18; with a blow up of a prior art table on p. 17; see attachment showing "ANGLE BASIC" verses "ADVANCE +/−.002".

* cited by examiner

*Primary Examiner* — Joshua E Freeman

(57) ABSTRACT

The invention is a bolt carrier with a modified cam path that prevents undesired contact between a cam pin and the sidewall of an upper receiver.

1 Claim, 16 Drawing Sheets

PRIOR ART

PRIOR ART

PRIOR ART

PRIOR ART

| TABLE 1 | | | |
|---|---|---|---|
| PRIOR ART CHART | | NEW ADVANCE (i.e. the present invention) | |
| ANGLE degrees | ADVANCE +/-.002 inches | ADDITIONAL ADVANCE inches | NEW ADVANCE +/-.002 inches |
| 0.00 | 0.042 | 0.043 | 0.085 |
| 0.25 | 0.044 | 0.050 | 0.094 |
| 0.50 | 0.046 | 0.053 | 0.099 |
| 1.00 | 0.050 | 0.054 | 0.104 |
| 1.50 | 0.053 | 0.055 | 0.108 |
| 2.00 | 0.057 | 0.054 | 0.111 |
| 2.50 | 0.061 | 0.053 | 0.114 |
| 3.00 | 0.065 | 0.052 | 0.117 |
| 3.50 | 0.069 | 0.051 | 0.120 |
| 4.00 | 0.073 | 0.05 | 0.123 |
| 4.50 | 0.076 | 0.05 | 0.126 |
| 5.00 | 0.080 | 0.049 | 0.129 |
| 5.50 | 0.084 | 0.048 | 0.132 |
| 6.00 | 0.088 | 0.047 | 0.135 |
| 6.50 | 0.092 | 0.046 | 0.138 |
| 7.00 | 0.096 | 0.045 | 0.141 |
| 7.50 | 0.099 | 0.045 | 0.144 |
| 8.00 | 0.103 | 0.044 | 0.147 |
| 8.50 | 0.107 | 0.043 | 0.150 |
| 9.00 | 0.111 | 0.042 | 0.153 |
| 9.50 | 0.114 | 0.042 | 0.156 |
| 10.00 | 0.118 | 0.041 | 0.159 |
| 10.50 | 0.122 | 0.04 | 0.162 |
| 11.00 | 0.126 | 0.039 | 0.165 |
| 11.50 | 0.130 | 0.038 | 0.168 |
| 12.00 | 0.134 | 0.037 | 0.171 |
| 12.50 | 0.137 | 0.037 | 0.174 |
| 13.00 | 0.141 | 0.036 | 0.177 |
| 13.50 | 0.145 | 0.036 | 0.181 |
| 14.00 | 0.149 | 0.035 | 0.184 |
| 14.50 | 0.153 | 0.034 | 0.187 |
| 15.00 | 0.157 | 0.033 | 0.190 |
| 15.50 | 0.161 | 0.032 | 0.193 |
| 16.00 | 0.164 | 0.032 | 0.196 |
| 16.50 | 0.168 | 0.031 | 0.199 |
| 17.00 | 0.172 | 0.03 | 0.202 |
| 17.50 | 0.175 | 0.03 | 0.205 |
| 18.00 | 0.179 | 0.03 | 0.209 |
| 18.50 | 0.183 | 0.029 | 0.212 |
| 19.00 | 0.187 | 0.028 | 0.215 |

*FIG. 12A*

| Table 1 continued: | | | |
|---|---|---|---|
| 19.50 | 0.190 | 0.029 | 0.219 |
| 20.00 | 0.195 | 0.029 | 0.224 |
| 20.50 | 0.200 | 0.029 | 0.229 |
| 21.00 | 0.207 | 0.029 | 0.236 |
| 21.50 | 0.214 | 0.03 | 0.244 |
| 22.00 | 0.226 | 0.029 | 0.255 |
| 22.25 | 0.235 | 0.029 | 0.264 |
| 22.50 | 0.255 | 0.029 | 0.284 |

*FIG. 12B*

| TABLE 2 | |
|---|---|
| ANGLE Degrees | NEW ADVANCE +/-.002 inches |
| 0.00 | 0.085 |
| 0.25 | 0.094 |
| 0.50 | 0.099 |
| 1.00 | 0.104 |
| 1.50 | 0.108 |
| 2.00 | 0.111 |
| 2.50 | 0.114 |
| 3.00 | 0.117 |
| 3.50 | 0.120 |
| 4.00 | 0.123 |
| 4.50 | 0.126 |
| 5.00 | 0.129 |
| 5.50 | 0.132 |
| 6.00 | 0.135 |
| 6.50 | 0.138 |
| 7.00 | 0.141 |
| 7.50 | 0.144 |
| 8.00 | 0.147 |
| 8.50 | 0.150 |
| 9.00 | 0.153 |
| 9.50 | 0.156 |
| 10.00 | 0.159 |
| 10.50 | 0.162 |
| 11.00 | 0.165 |
| 11.50 | 0.168 |
| 12.00 | 0.171 |
| 12.50 | 0.174 |
| 13.00 | 0.177 |
| 13.50 | 0.181 |
| 14.00 | 0.184 |
| 14.50 | 0.187 |
| 15.00 | 0.190 |
| 15.50 | 0.193 |
| 16.00 | 0.196 |
| 16.50 | 0.199 |
| 17.00 | 0.202 |
| 17.50 | 0.205 |
| 18.00 | 0.209 |
| 18.50 | 0.212 |
| 19.00 | 0.215 |
| 19.50 | 0.219 |

*FIG. 13A*

| | |
|---|---|
| 20.00 | 0.224 |
| 20.50 | 0.229 |
| 21.00 | 0.236 |
| 21.50 | 0.244 |
| 22.00 | 0.255 |
| 22.25 | 0.264 |
| 22.50 | 0.284 |

*FIG. 13B*

| # | Parts |
|---|---|
| 100 | prior art upper receiver 100 |
| 110 | upper receiver 110 according to the present invention |
| 120 | bolt 120 |
| 140 | carrier and key 140 |
| 150 | barrel extension 150 |
| 160 | cam pin 160 |
| 180 | carrier cam slot 180 |
| 200 | top of cam pin 200 |
| 220 | upper receiver sidewall 220 |
| 240 | bolt lugs 240 |
| 260 | prior art cam path 260 |
| 280 | modified cam path 280 |
| 300 | theoretical center line |
| 320 | firing pin hole |

*FIG. 14*

BOLT CARRIER WITH A MODIFIED CAM PATH

CROSS REFERENCE TO RELATED APPLICATIONS

This application claims the benefit of U.S. Application No. 62/593,965, filed Dec. 3, 2017, the content of which is incorporated herein by reference in its entirety.

STATEMENT REGARDING FEDERALLY SPONSORED RESEARCH OR DEVELOPMENT

Not Applicable.

FIELD OF THE INVENTION

The present invention relates generally to bolt carriers in the M16 family of rifles such as AR-15 type rifles. More specifically, the invention is a bolt carrier with a modified cam path that prevents undesired contact between a cam pin head and the sidewall of an upper receiver.

BACKGROUND OF THE INVENTION

Prior art bolt carriers typically have a cam path that only rotates a bolt by 20.7° as shown in comparative FIG. 3. More specifically, the prior art cam path causes a degree of rotation of less than 22.5° thereby causing the cam pin to strike the upper receiver sidewall thereby causing an undesired groove to be formed in the sidewall of the upper receiver. The present invention solves this problem by providing a modified cam path resulting in a rotation of 22.5° thereby preventing the cam pin from striking the sidewall of the upper receiver.

SUMMARY

The invention is a bolt carrier with a modified cam path that prevents undesired contact between a cam pin head and the sidewall of an upper receiver.

BRIEF DESCRIPTION OF THE DRAWINGS

FIG. 12A and FIG. 12B show Table 1.

FIG. 13A and FIG. 13B show Table 2.

FIG. 14 is a summary table of parts.

DETAILED DESCRIPTION OF THE PREFERRED EMBODIMENTS OF THE INVENTION

Figure 3:
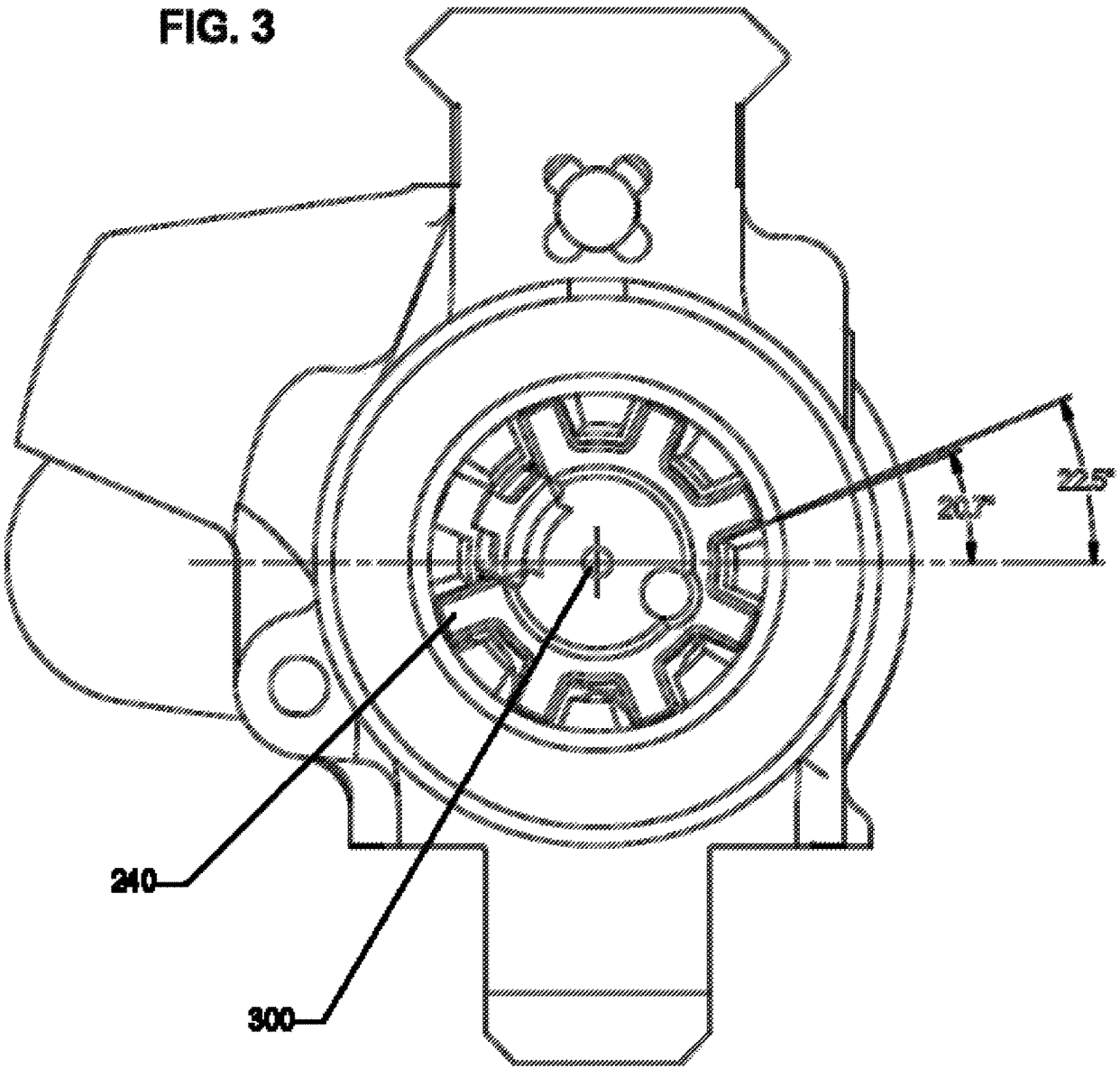
FIG. 3 shows a comparison of rotation between a prior art bolt carrier and a bolt carrier according to the present invention.

The modified cam path of the present invention ensures that the bolt, and hence the bolt lugs, rotate a full 22.5° (see FIG. 3) and the bolt clears the locking lugs. In addition, the modified cam path of the invention ensures that the cam pin (and in particular the cam pin head) does not strike the upper receiver as typically happens in prior art bolt carriers.

Figure 5:
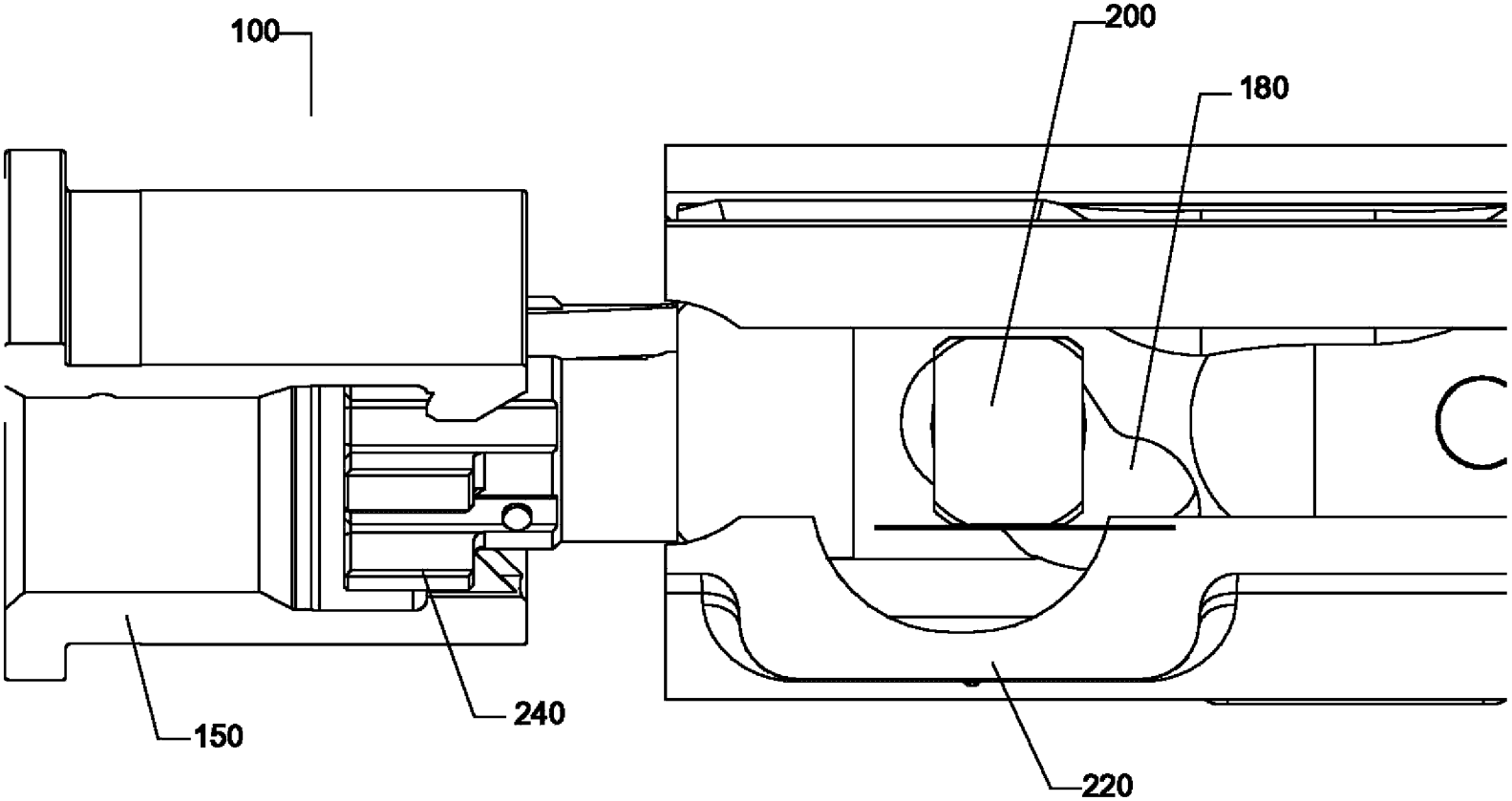
FIG. 5 PRIOR ART

The prior art cam path causes a degree of rotation of less than 22.5° (see comparative FIG. 3) thereby causing the cam pin (see top of cam pin 200 in FIG. 6) to strike an upper receiver sidewall 220 thereby causing damage to a prior art upper receiver 100. FIG. 5 shows a prior art cam pin (see top of cam pin 200) in rearward motion corresponding to less than 22.5° of rotation of bolt lugs 240 (shown, for example, in FIG. 8).

Table 1 (see FIGS. 12A and 12B) compares the new cam path compared to the prior art cam path. Specifically, the second columns of Table 1 shows the cutting path of the prior art, i.e., the path followed by a cutting tool (not shown) to provide the prior art cam path in the bolt carrier. Columns 3 and 4 represent the present invention wherein the new cutting path in the bolt carrier is shown in column 4 to provide the new cam path; the difference between the prior art and the new cutting path is represented by column 3.

Table 2 (see FIGS. 13A and 13B) shows the actual cam path according to the present invention. For example, at 0.50° the new advance is 0.099 inches, i.e., ninety nine thousandths of an inch (+/−0.002 inches, i.e. plus/minus two thousandths of an inch), compared to 0.046 inches (+/−0.002 inches) with respect to the prior art (see Table 1). With the new cam path of the present invention the damage to the upper receiver is substantially or completely reduced. In addition, the bolt lugs reliably rotate a full 22.5°.

Figure 1:
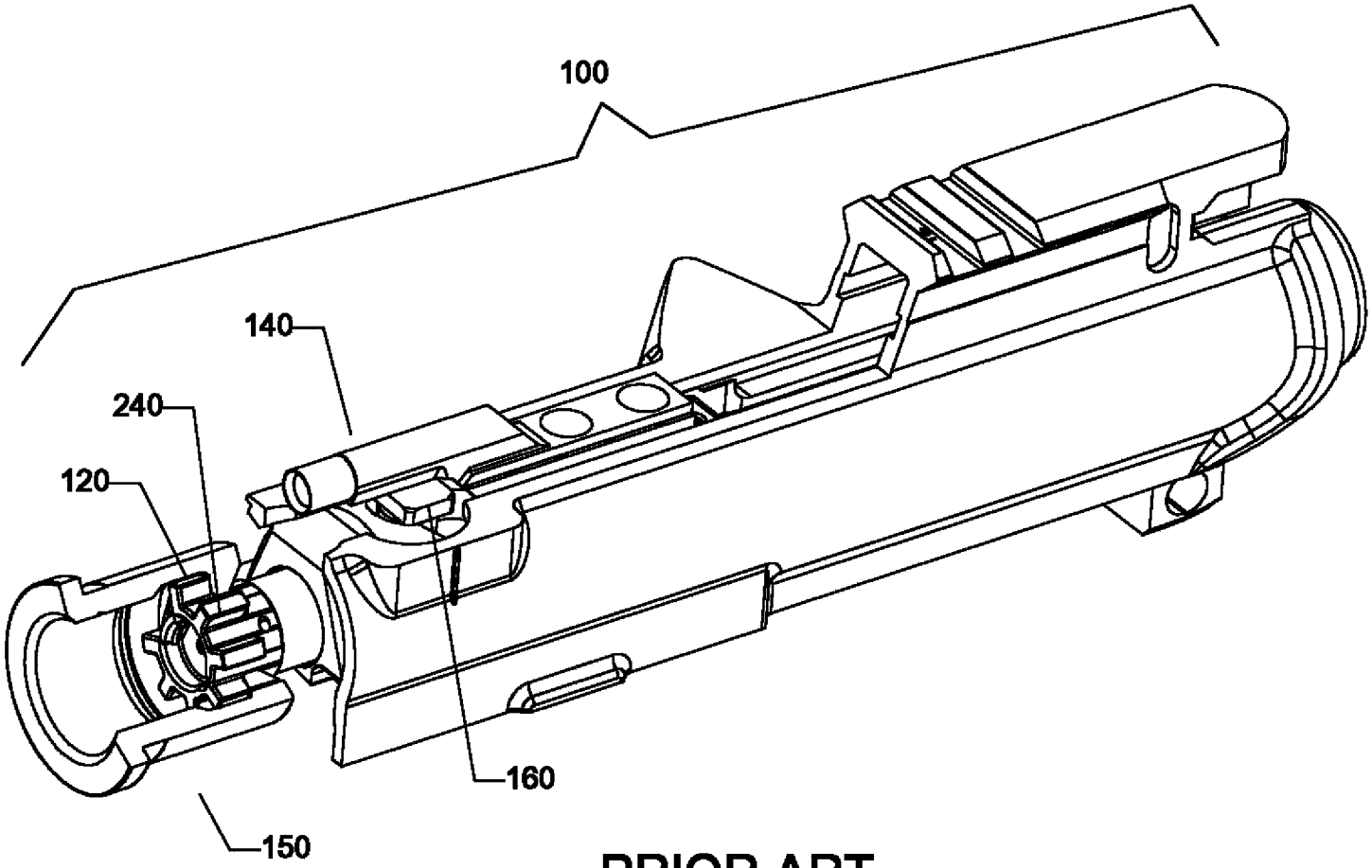
FIGS. 1 and 2 show aspects of the prior art bolt carrier.
Figure 2:
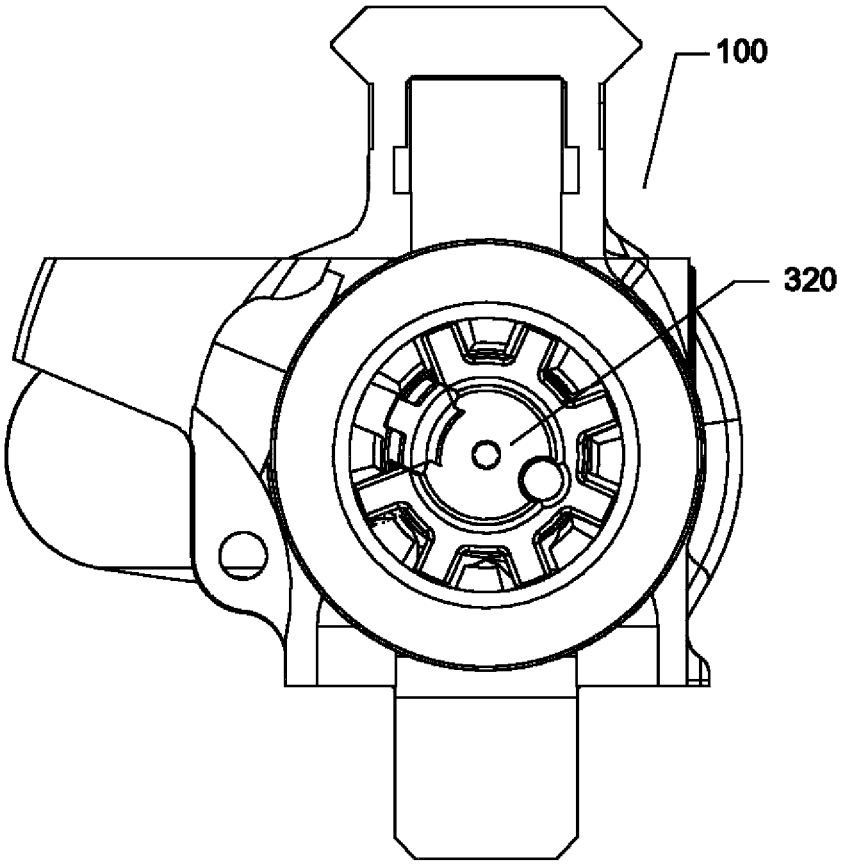
Figure 4:
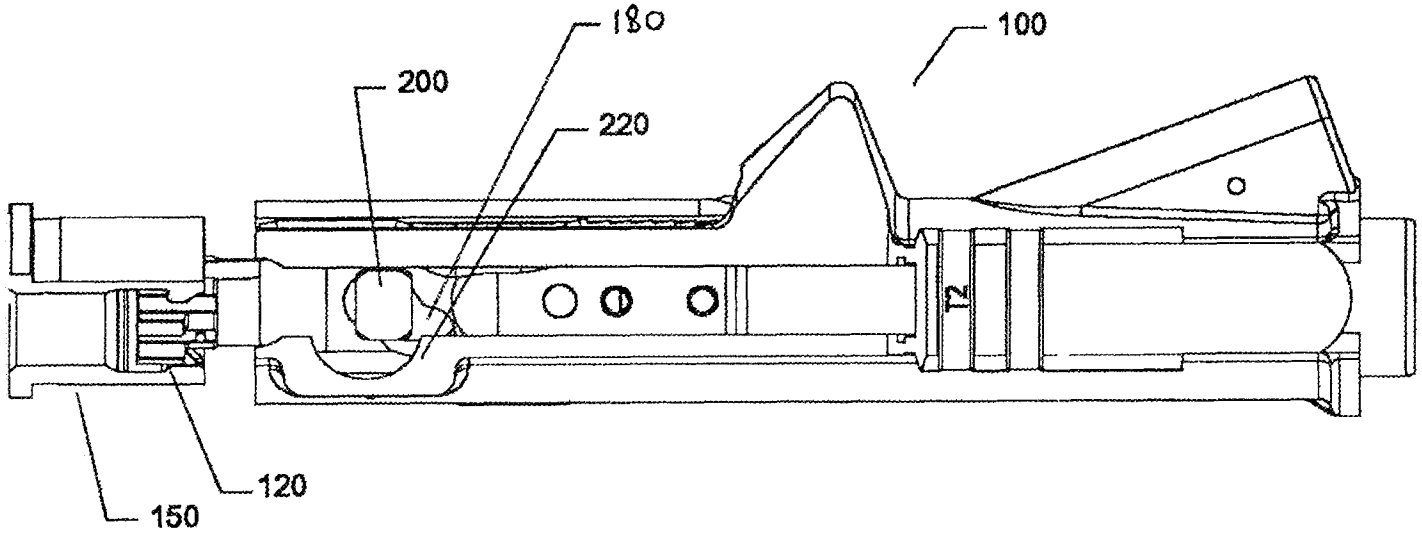
FIG. 4 through FIG. 6 shows aspects of the prior art bolt carrier.
Figure 6:
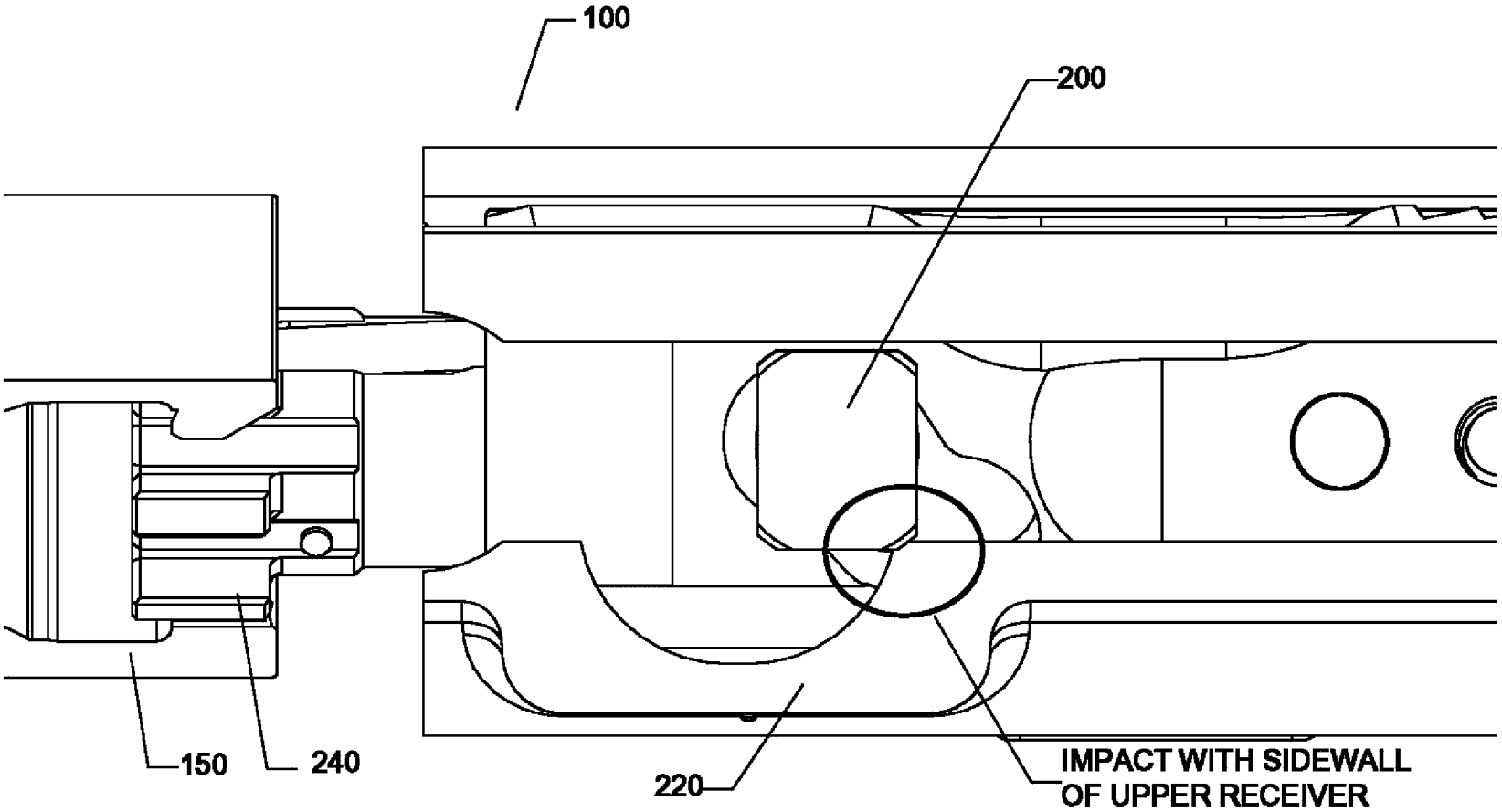

FIG. 1 shows a prior art upper receiver 100 of a typical standard AR-15. The upper receiver 100 is shown comprising a bolt 120, carrier and key 140, a barrel extension 150, and a cam pin 160. FIG. 2 shows a front end view of a prior art upper receiver 100. In the prior art upper receiver the bolt 120 will never initially travel rearward along a theoretical center-line (labeled as "300" in FIG. 3). FIG. 4 shows a prior art bolt 120 in rearward motion via a standard carrier cam slot 180. FIG. 6 is a prior art figure in which the cam pin (see top of cam pin 200) is shown impacting a sidewall 220 of the upper receiver 100.

Figure 7:
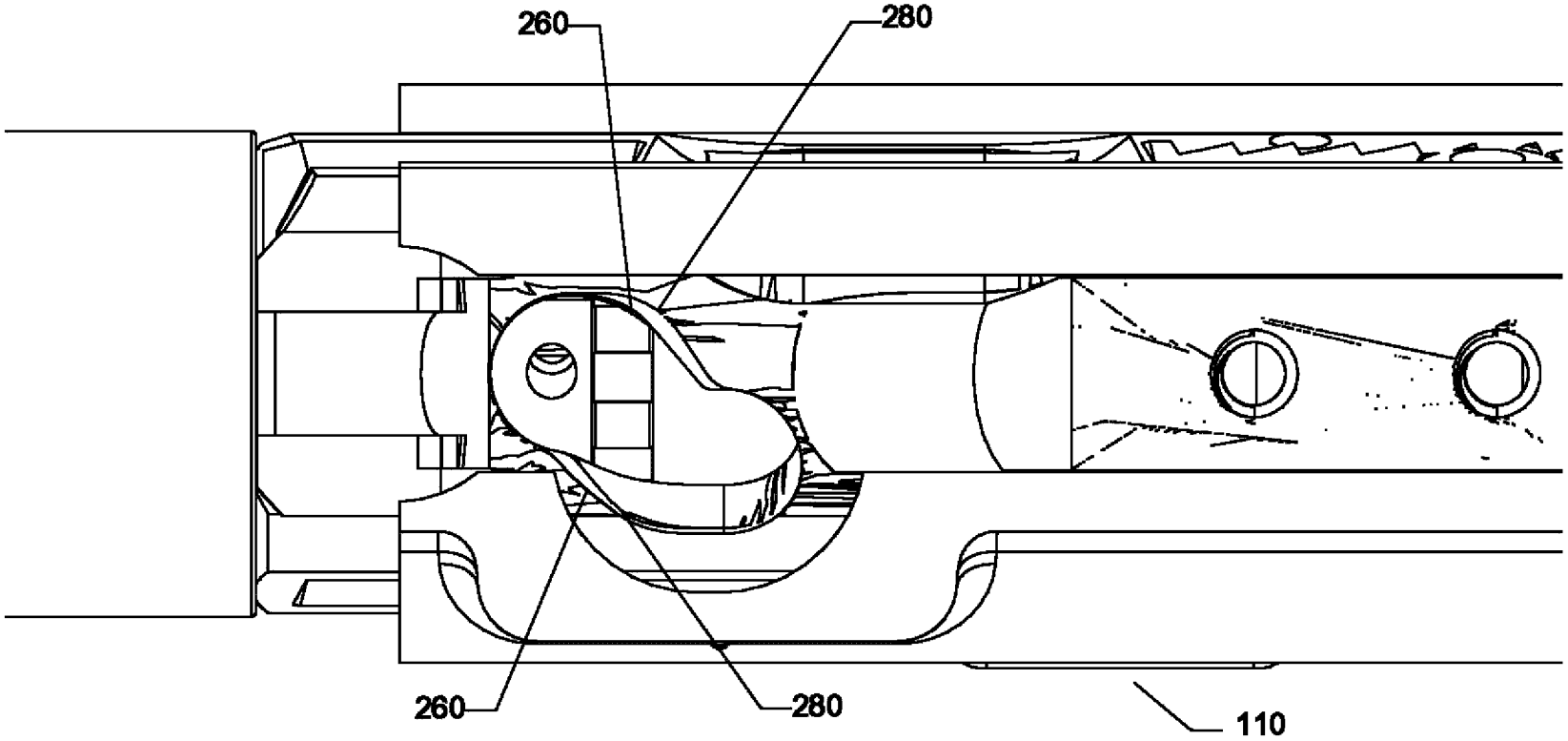
FIG. 7 shows a comparative rendition of a prior art cam path and the cam path according to the present invention.
Figure 8:
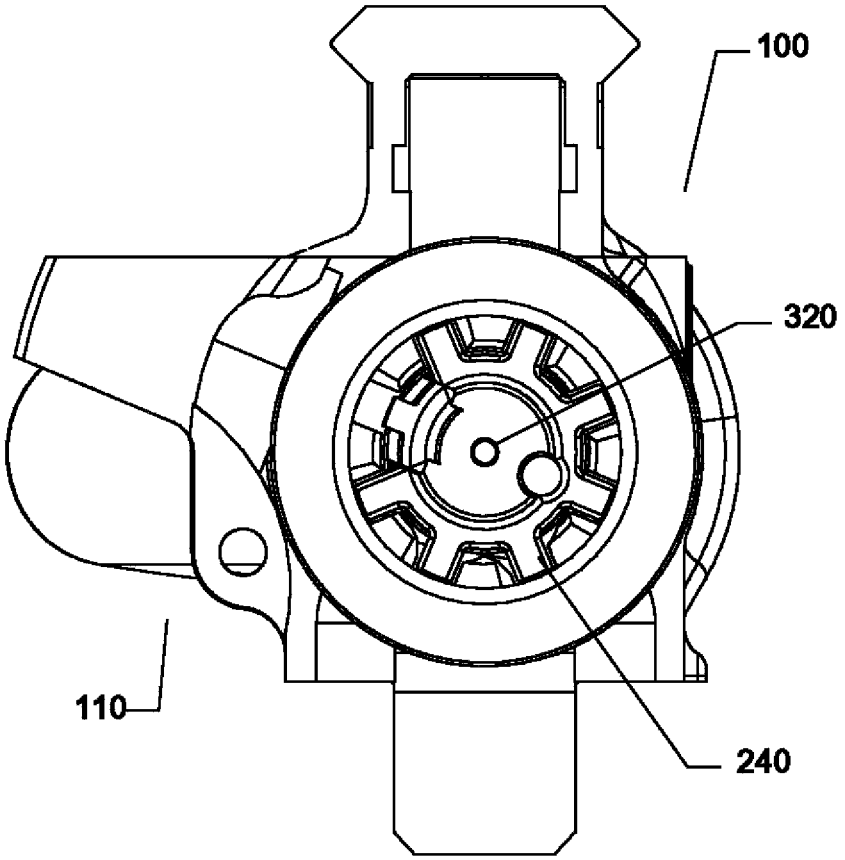
FIG. 8 through FIG. 11 shows aspects of the present invention.

In FIG. 7 the prior art cam path 260 is shown compared to the modified cam path 280 of the present invention. The modified cam path 280 corresponds to a full 22.5degree rotation of the bolt lugs 240. In the modified cam path the cam pin does not impact of the sidewall 220 of the upper receiver. In FIG. 8 a full rotation of 22.5° of the bolt lugs 240 (and hence the bolt since the bolt comprises the bolt lugs).

Figure 9:
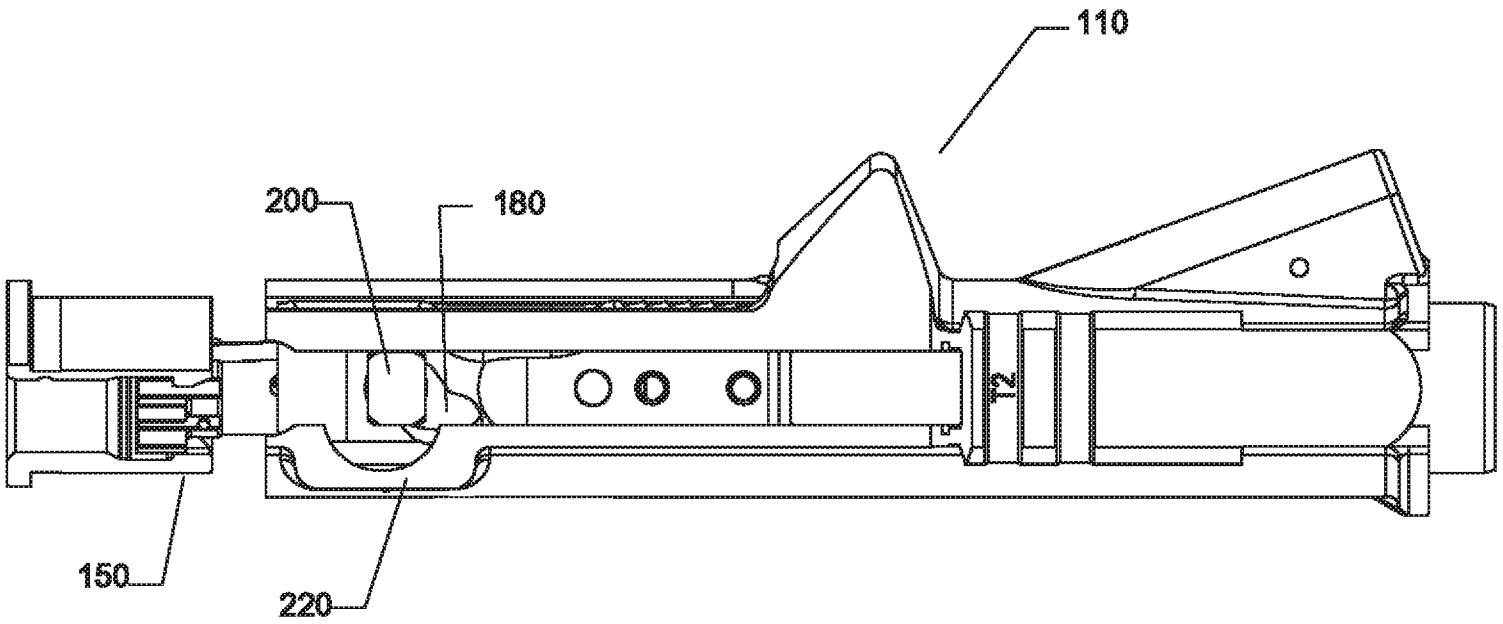
Figure 10:
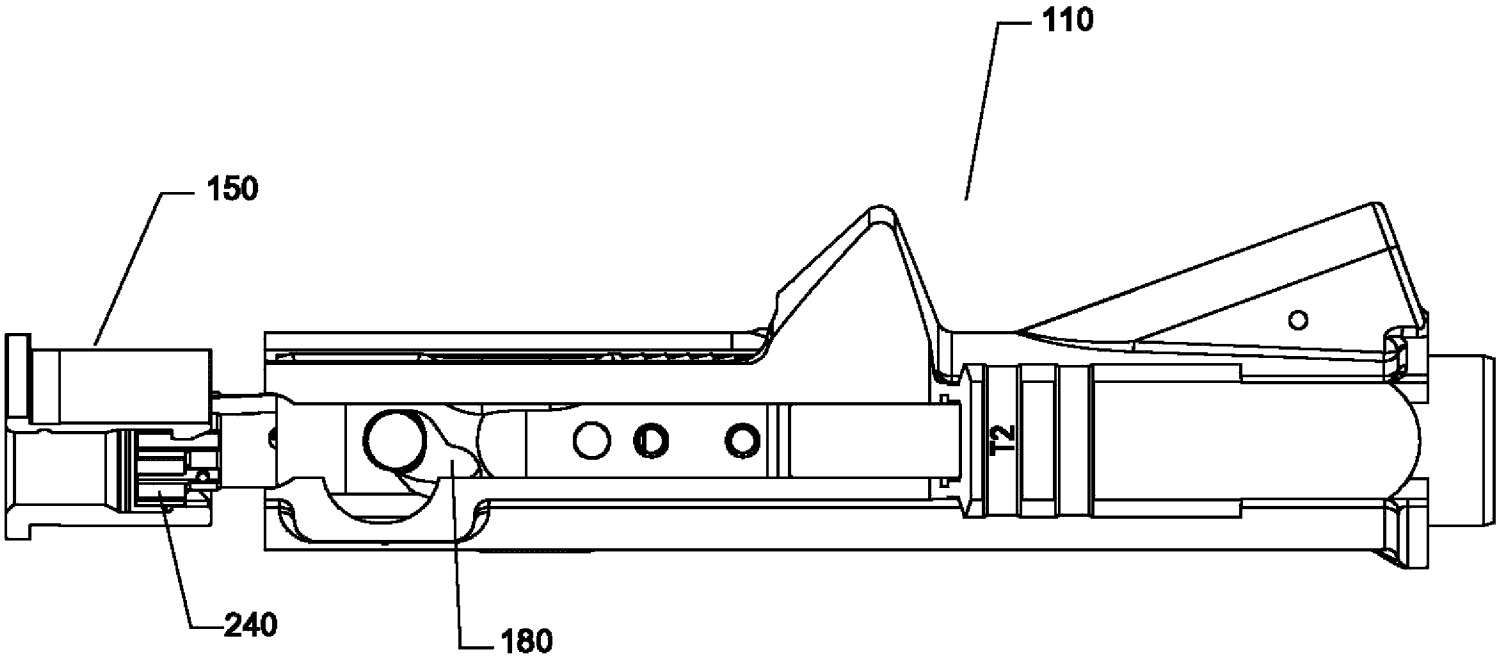
Figure 11:
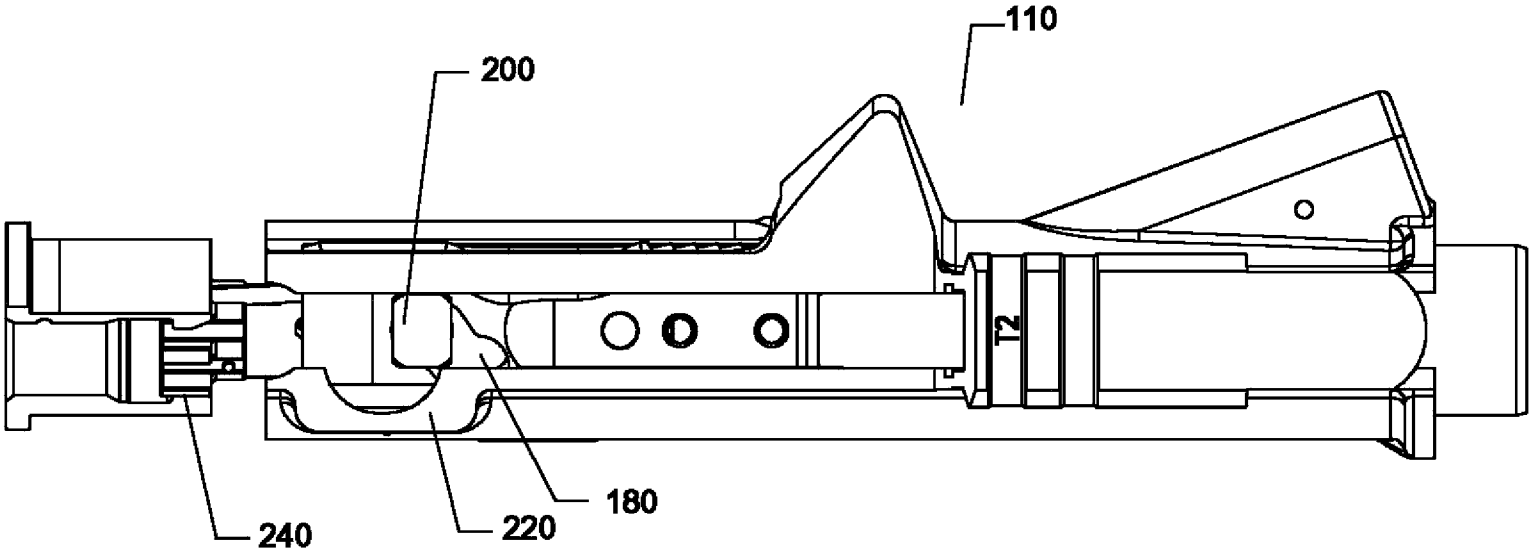

In FIGS. 9, 10 and 11 the result of proper engagement of the cam pin corresponding to 22.5° of rotation of the bolt lugs 240 results in no impact between the cam pin and the sidewall 220 of the upper receiver 110 according to the present invention.

The invention claimed is:

1. A bolt carrier for a firearm having a modified cam path, said bolt carrier comprising bolt lugs which form part of a bolt, said bolt lugs having a degree of rotation, said modified cam path having an advance relative to said degree of rotation as defined in table 2 shown in FIGS. 13A and 13B, wherein said modified cam path prevents undesired contact between a cam pin head and a sidewall of an upper receiver of said firearm.

* * * * *